US007771005B2

(12) United States Patent
Jung et al.

(10) Patent No.: US 7,771,005 B2
(45) Date of Patent: Aug. 10, 2010

(54) IMAGE FORMING APPARATUS AND METHOD OF DRIVING THE SAME

(75) Inventors: Young-gun Jung, Gunpo-si (KR); Jin-ho Park, Yongin-si (KR); Dong-woo Ha, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 781 days.

(21) Appl. No.: 11/566,813

(22) Filed: Dec. 5, 2006

(65) Prior Publication Data

US 2007/0291073 A1 Dec. 20, 2007

(30) Foreign Application Priority Data

Jun. 19, 2006 (KR) ..... 10-2006-0054987

(51) Int. Cl.
*B41J 2/165* (2006.01)

(52) U.S. Cl. ..... 347/33

(58) Field of Classification Search ..... 347/29, 347/30

See application file for complete search history.

(56) References Cited

U.S. PATENT DOCUMENTS

| | | | | |
|---|---|---|---|---|
| 5,266,974 | A * | 11/1993 | Koitabashi et al. | 347/33 |
| 6,435,649 | B2 * | 8/2002 | Takahashi et al. | 347/33 |
| 6,709,090 | B2 * | 3/2004 | Okazaki et al. | 347/65 |
| 7,108,350 | B2 | 9/2006 | Ishihara | |
| 2005/0012777 | A1 | 1/2005 | Ishihara | |
| 2005/0264601 | A1 | 12/2005 | Park | |
| 2006/0066664 | A1 * | 3/2006 | Kachi et al. | 347/33 |
| 2006/0066665 | A1 | 3/2006 | Kachi et al. | |

FOREIGN PATENT DOCUMENTS

| | | |
|---|---|---|
| CN | 1572506 | 2/2005 |
| EP | 0858895 | 8/1998 |
| EP | 0943441 | 9/1999 |
| EP | 1366907 | 12/2003 |
| EP | 1454750 | 9/2004 |
| EP | 1616702 | 1/2006 |
| EP | 1658980 | 5/2006 |
| JP | 2001-10083 | 1/2001 |
| JP | 2002-36594 | 2/2002 |
| JP | 2004-9358 | 1/2004 |
| KR | 2005-108162 | 11/2005 |

OTHER PUBLICATIONS

European Search Report dated Oct. 5, 2007 issued in EP 07103107.4.
Chinese Office Action issued Dec. 25, 2009 in CN Application No. 2007100960082.

* cited by examiner

*Primary Examiner*—Stephen Meier
*Assistant Examiner*—Alexander C Witkowski
(74) *Attorney, Agent, or Firm*—Stanzione & Kim, LLP

(57) ABSTRACT

An image forming apparatus and a method of driving the image forming apparatus. The image forming apparatus includes, an ink cartridge including a plurality of print heads arranged in a width direction of a paper sheet crossing a direction along which the printing medium is transferred, a wiping unit moving in the transfer direction to wipe nozzle surfaces of the plurality of print heads, and a controller independently driving the plurality of print heads which have been wiped by the wiping unit, so that color nozzles of the plurality of print heads spray predetermined amounts of inks.

18 Claims, 9 Drawing Sheets

IMAGE FORMING APPARATUS AND METHOD OF DRIVING THE SAME

CROSS-REFERENCE TO RELATED APPLICATIONS

This application claims the benefit under 35 U.S.C. 119 §(a) of Korean Patent Application No. 10-2006-0054987, filed on Jun. 19, 2006, in the Korean Intellectual Property Office, the disclosure of which is incorporated herein in its entirety by reference.

BACKGROUND OF THE INVENTION

1. Field of the Invention

The present general inventive concept relates to an image forming apparatus and a method of driving the same. More particularly, the present general inventive concept relates to an array print head type image forming apparatus including a plurality of print heads arranged in a width direction of a paper sheet and a method of driving the same.

2. Description of the Related Art

In general, image forming apparatuses, such as ink-jet printers, spit minute droplets of printing inks in desired positions on printing media such as paper sheets, fabrics, or the like, to print images of predetermined colors on surfaces of the printing media.

General ink-jet printers include ink cartridges which move in a direction orthogonal to a direction along which paper sheets are transferred, i.e., in a width direction of the paper sheets, and print images on the paper sheets. However, such an ink-jet printer has a slow printing speed.

Ink cartridges having a plurality of print heads arranged throughout a width direction of a paper sheet have been recently adopted to provide ink-jet printers capable of printing images at a fast speed without moving ink cartridges back and forth. Such ink-jet printers are also called array print head type ink-jet printers.

A conventional array print head type ink cartridge includes a plurality of ink tanks, a plurality of negative pressure adjusters, a plurality of print heads, and an ink channel unit. The plurality of ink tanks store printing inks. The plurality of negative pressure adjusters are respectively connected to the plurality of ink tanks. The plurality of print heads are arranged in a predetermined pattern in a width direction of a printing medium. The ink channel unit supplies the printing inks from the plurality of ink tanks to the plurality of print heads.

The plurality of ink tanks are installed in a frame and respectively store inks of several colors, for example, yellow (Y), magenta (M), cyan (C), and black (B) inks.

The plurality of negative pressure adjusters are installed underneath the frame to be respectively connected to the plurality of ink tanks. The plurality of negative pressure adjusters generate negative pressures to prevent the inks from leaking.

The ink channel unit is connected to the plurality of negative pressure adjusters and feeds the plurality of print heads with the inks which flow from the plurality of ink tanks into the ink channel unit through the plurality of negative pressure adjusters.

The plurality of print heads are arranged in the predetermined pattern on a front surface of the ink channel unit to be attached to the ink channel unit. Each of the plurality of print heads includes a plurality of nozzles through which the inks are spat. The inks fed from the ink channel unit are spat through the nozzles onto a printing medium so as to print an image on the printing medium. In particular, the nozzles are classified by colors. In general, the nozzles are sequentially arranged by colors in a direction along which paper sheets are transferred.

An array print head type image forming apparatus as described above has a considerably increased printing speed and a simplified structure, but has the following problems.

In order to wipe a plurality of print heads arranged in the width direction of the paper sheet, a blade must be transferred in either a width direction of a paper sheet or a direction along which the paper sheet is transferred. If the blade is transferred in the width direction of the paper sheet, the blade possesses a small surface area in which the plurality of print heads are wiped. Thus, a large amount of ink sticks to the blade during the wiping process. As a result, a normal wiping operation is not performed, and a large amount of time is required for wiping.

Accordingly, a method of moving a blade lengthened in a width direction of a paper sheet toward a direction along which the paper sheet is transferred in order to wipe a plurality of print heads has been suggested. If print heads are wiped using such a method, inks of different colors are pushed into color nozzles sequentially arranged in a direction along which a paper sheet is transferred. Thus, the inks of different colors are mixed. As a result, quality of a printed image becomes deteriorated.

Therefore, a method of rapidly and clearly wiping print heads and preventing ink colors from being mixed is required.

SUMMARY OF THE INVENTION

The present general inventive concept provides an image forming apparatus having a simple structure capable of easily wiping print heads and a method of driving the same.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing an image forming apparatus including an ink cartridge including a plurality of print heads arranged in a width direction of a paper sheet to cross a direction along which a printing medium is transferred, a wiping unit to move in the transfer direction to wipe nozzle surfaces of the plurality of print heads, and a controller to independently drive the plurality of print heads which have been wiped by the wiping unit, so that color nozzles of the plurality of print heads spray predetermined amounts of inks.

Each of the plurality of print heads may include the color nozzles which are spaced apart from one another in the transfer direction and are positioned parallel to the width direction to spray inks of different colors, wherein the color nozzles are independently driven by the controller.

The controller may control the color nozzles of the plurality of print heads to sequentially spray inks in an order in which the plurality of print heads are wiped by the wiping unit.

The plurality of print heads may be arranged in first and second rows to be positioned parallel to the width direction and spaced apart from one another in the transfer direction, and the wiping unit may wipe the print heads in the first row and then the print heads in the second row.

The controller may control the printing heads in the first row so that the color nozzles of the print heads in the first row simultaneously spray inks after the print heads in the first row are completely wiped and then the print heads in the second row so that the color nozzles of the print heads in the second row simultaneously spray inks after the print heads in the second row are completely wiped.

The wiping unit may include a blade parallel to the width direction to wipe the plurality of print heads, a frame supporting the blade and including a container containing inks sprayed from the wiped print heads, and a driver to move the frame back and forth along a predetermined path so that the blade wipes the nozzle surfaces of the print heads.

A pair of blades may be provided parallel to the width direction.

The foregoing and/or other aspects and utilities of the present general inventive concept may also be achieved by providing a method of driving an image forming apparatus, including wiping nozzle surfaces of a plurality of print heads arranged in a width direction of a paper sheet crossing a direction along which the printing medium is transferred, and spraying inks penetrating into wiped color nozzles to remove the inks.

The wiping of the nozzle surfaces of the plurality of print heads arranged in the width direction of the paper sheet to cross the direction along which the printing medium is transferred may include providing a blade parallel to the width direction and having enough length to simultaneously overlap with the plurality of print heads, and moving the blade in the transfer direction so that the blade wipes the nozzle surfaces of the plurality of print heads.

The color nozzles may sequentially spray the inks in an order of wiping the color nozzles using the blade.

A speed of sequentially spraying the inks from the color nozzles may be proportional to a speed of moving the blade.

The plurality of print heads may be arranged in first and second rows to be spaced apart from one another toward the transfer direction. The spraying of the inks penetrating into the wiped color nozzles to remove the inks may include, simultaneously driving the plurality of print heads in the first row which are completely wiped to spray the inks, and simultaneously driving the plurality of print heads in the second row which are completely wiped to spray the inks.

The method may further include collecting the sprayed inks.

The foregoing and/or other aspects and utilities of the present general inventive concept may also be achieved by providing an image forming apparatus including a wiping unit to move in a direction parallel to a direction in which a printing medium is transferred to wipe nozzles of print heads arranged in a plurality of rows along the transferring direction, and a controller to drive the wiped print head nozzles to spit a predetermined amount of ink.

The print head nozzles may sequentially spit the inks in an order of wiping the nozzles using the wiping unit.

A speed of sequentially spitting the inks from the print head nozzles may be proportional to a speed of moving the wiping unit.

The image forming apparatus may also include a container to collect the ink spit from the print head nozzles.

The foregoing and/or other aspects and utilities of the present general inventive concept may also be achieved by providing a method of driving an image forming apparatus, the method including moving a wiping unit in a direction parallel with a direction in which a printing medium is transferred to wipe nozzles of print heads arranged in a plurality of rows along a transferring direction and controlling the nozzles to spit a predetermined amount of ink in a sequence corresponding to the sequence in which the nozzles are wiped.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
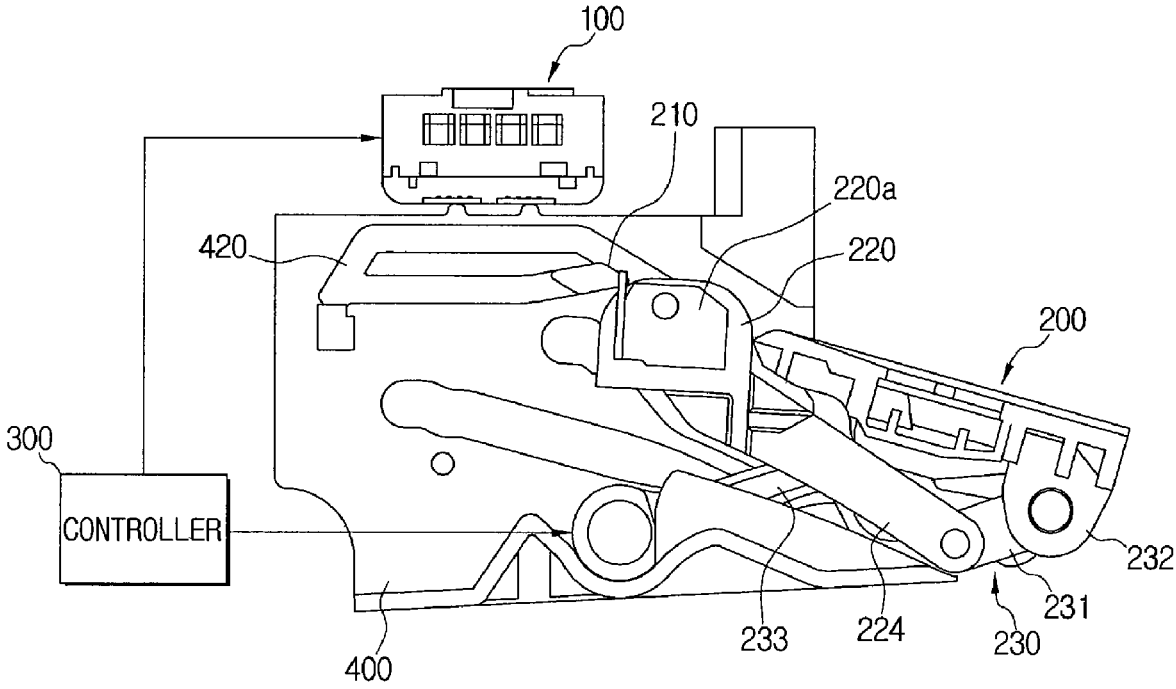
FIG. 1 is a schematic view illustrating a structure of an image forming apparatus according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Hereinafter, an image forming apparatus and a method of driving the image forming apparatus will be described in detail with reference to the attached drawings.

FIG. 1 is a schematic view illustrating a structure of an image forming apparatus according to an embodiment of the present general inventive concept. Referring to FIG. 1, the image forming apparatus according to the present embodiment includes an ink cartridge 100, a wiping unit 200, and a controller 300.

The ink cartridge 100 is used in an array head type ink-jet printer and has a structure in which a plurality of print heads are arranged along a width direction of a paper sheet as a printing medium. An example of the ink cartridge 100 will now be described with reference to FIGS. 2 and 3.

Figure 2:
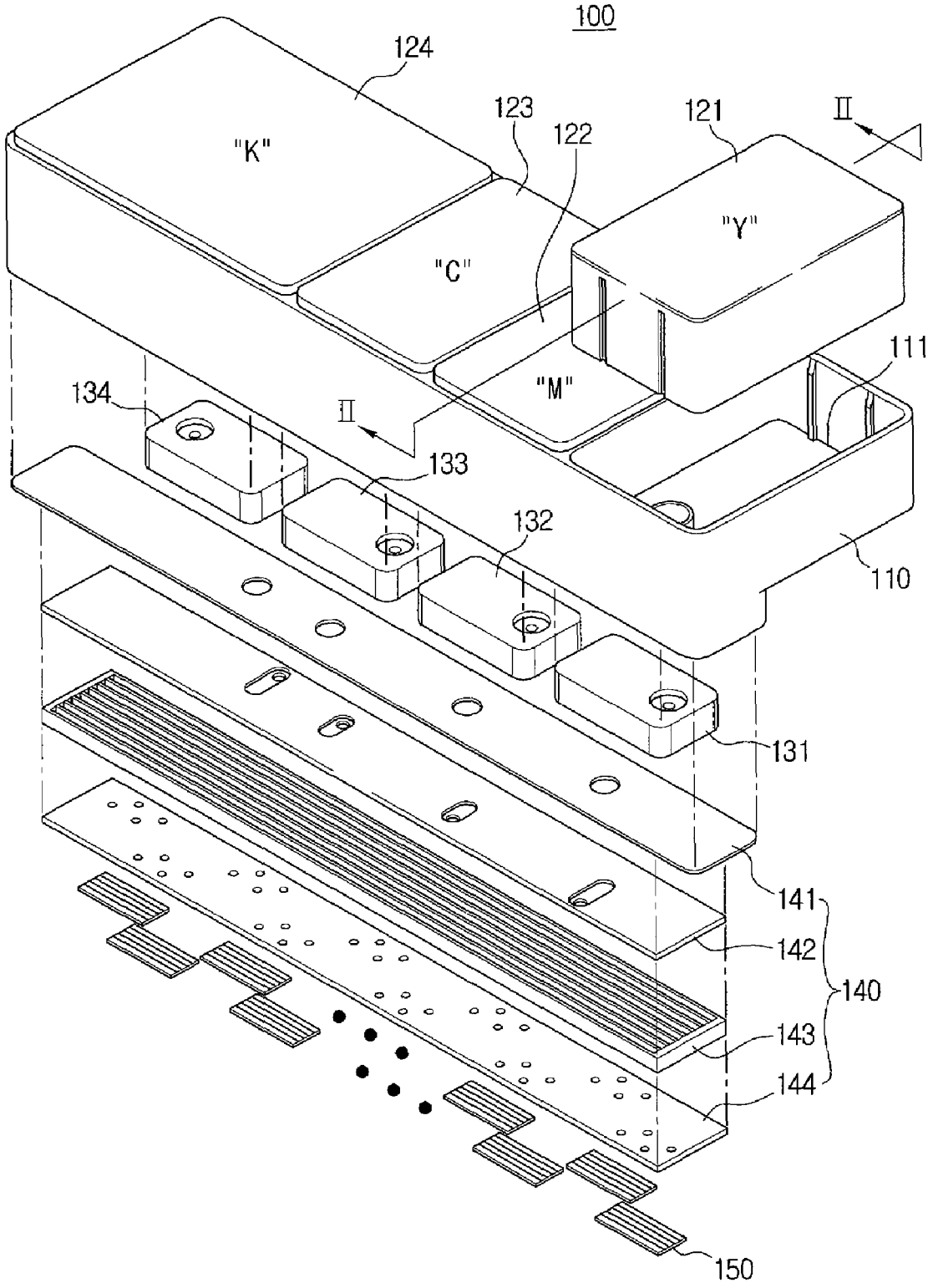
FIG. 2 is a schematic of an exploded perspective view of an ink cartridge illustrated in FIG. 1.
Figure 3:
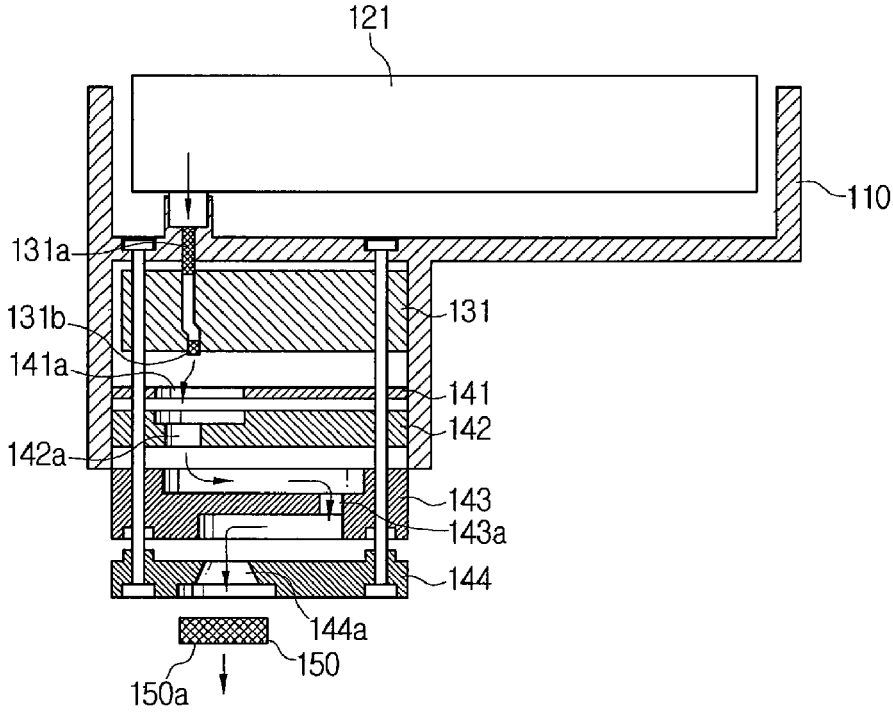
FIG. 3 is a cross-sectional view taken along line II-II of FIG. 2.

Referring to FIGS. 2 and 3, the ink cartridge 100 includes a plurality of ink tanks 121 through 124, a plurality of negative pressure adjusters 131 through 134, a plurality of print heads 150, and an ink channel unit 140. The plurality of ink tanks 121 through 124 store printing inks. The plurality of negative pressure adjusters 131 through 134 are respectively connected to the plurality of ink tanks 121 through 124. The plurality of print heads 150 are arranged in a predetermined pattern in the width direction of the printing medium. The ink channel unit 140 feeds the printing inks from the plurality of ink tanks 121 through 124 to the plurality of print heads 150.

The plurality of ink tanks 121 through 124 are installed in a frame 110. The plurality of ink tanks 121 through 124 respectively store inks of several colors, for example, yellow, magenta, cyan, and black inks.

The frame 110 includes a tank installing part 111 on which the plurality of ink tanks 121 through 124 are installed.

The plurality of negative pressure adjusters 131 through 134 are installed underneath the frame 110 to be respectively connected to the plurality of ink tanks 121 through 124. The plurality of negative pressure adjusters 131 through 134 generate negative pressures to prevent the printing inks from leaking. FIG. 3 illustrates an upper negative pressure tube 131*a* and a lower negative pressure tube 131*b*.

The ink channel unit 140 is connected to the plurality of negative pressure adjusters 131 through 134 and feeds the plurality of print heads 150 with the printing inks which flow from the plurality of ink tanks 121 through 124 into the ink channel unit 140 through the plurality of negative pressure adjusters 131 through 134.

A plurality of channel plates 141 through 144 are stacked and combined with one another to form the ink channel unit 140. The channel plate 141 of the plurality of channel plates 141 through 144, which is connected to the plurality of negative pressure adjusters 131 through 134, may be a pressure plate. For example, as illustrated in FIGS. 2 and 3, the channel plates 142, 143, and 144, i.e., first, second, and third channel plates 142, 143, and 144, may be sequentially stacked on the pressure plate 141 to manufacture the ink channel unit 140. Alternatively, the pressure plate 141 may not be included in the manufacture of the ink channel unit 140. Also, the ink channel unit 140 may include two, four, or more channel plates.

Referring to FIG. 3, the plurality of channel plates 141 through 144 respectively include channels 141*a* through 144*a* through which the printing inks pass. The channels 141*a* through 144*a* are connected to one another according to colors of the printing inks.

Figure 4:
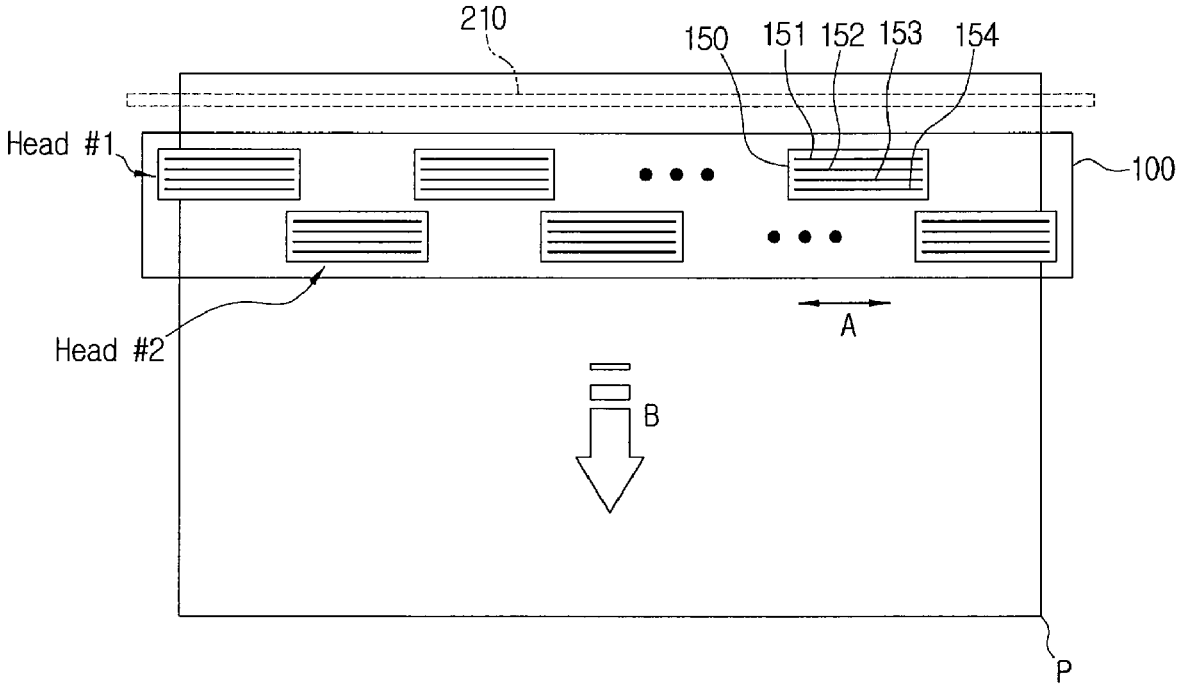
FIG. 4 is a view illustrating an arrangement state of print heads illustrated in FIG. 2.

As illustrated in FIG. 4, the plurality of print heads 150 are classified into print heads Head #1 and Head #2, in first and second rows, which are parallel to a width direction A of a paper sheet P, and spaced apart from one another in a direction B along which the paper sheet P is transferred. Also, each of the plurality of print heads 150 includes color nozzles 151 through 154 which are spaced apart from one another in the direction B and each eject inks of different colors onto the paper sheet P. The color nozzles 151 through 154 may be lined up in the width direction A.

Hundreds of color nozzles 151 through 154 are provided in each of the plurality of print heads 150 to eject an ink of each color in a desired position of the paper sheet P during a printing operation. When the color nozzles 151 through 154 eject an ink, a portion of the ejected ink remains on nozzle surfaces 150*a* of the plurality of print heads 150 and at entrances of the color nozzles 151 through 154. If the ink remaining on the nozzle surfaces 150*a* or at the entrances of the color nozzles 151 through 154 is left thereon, the ink may contaminate a paper sheet transferred during a next printing operation. Also, if the ink remaining at the entrances of the color nozzles 151 through 154 hardens, the color nozzles 151 through 154 may become blocked and thus may not spit the ink. Thus, a normal color of an image may not be realized or the image may not be precisely realized during the next printing operation.

Accordingly, the plurality of print heads 150 are driven by a control signal output from the controller 300 to perform a spitting operation in which the color nozzles 151 through 154 arbitrarily spit predetermined amounts of inks periodically or whenever necessary. The spitting operation may prevent the color nozzles 151 through 154 from being blocked by hardened ink remaining at the entrances of the colors nozzles 151 through 154. Also, when the nozzle surfaces 150*a* are wiped by the wiping unit 200, inks pushed into the color nozzles 151 through 154 from the nozzle surfaces 150 due to a wiping operation may be spat so as to prevent the inks from being mixed. The spitting operation and method will be described in detail later.

The wiping unit 200 wipes the inks sticking to the nozzle surfaces 150*a* of the plurality of print heads 150 as described above. The wiping unit 200 includes a blade 210, a frame 220 supporting the blade 210, and a driver 230 moving the frame 220.

As illustrated in FIG. 4, the blade 210 has a predetermined length in the width direction A of the paper sheet P and moves across the color nozzles 151 through 154 of each print head 150 in the direction B. When the blade 210 moves in the direction B, the blade 210 may be formed with enough length to wipe the plurality of print heads 150 through a one-time back-and-forth movement. In the present embodiment, one, two, or more blades 210 may be provided. When the blade 210 contacts the nozzle surfaces 150*a* of the plurality of print heads 150, the blade 210 is flexibly deformed and moves in contact with the nozzles surfaces 150*a* having a predetermined area. For this purpose, the blade 210 may be formed of a rubber or a rubber-mixed material. Also, the blade 210 stands upright at a side of an upper portion of the frame 220 to be supported by the frame 220.

Figure 5:
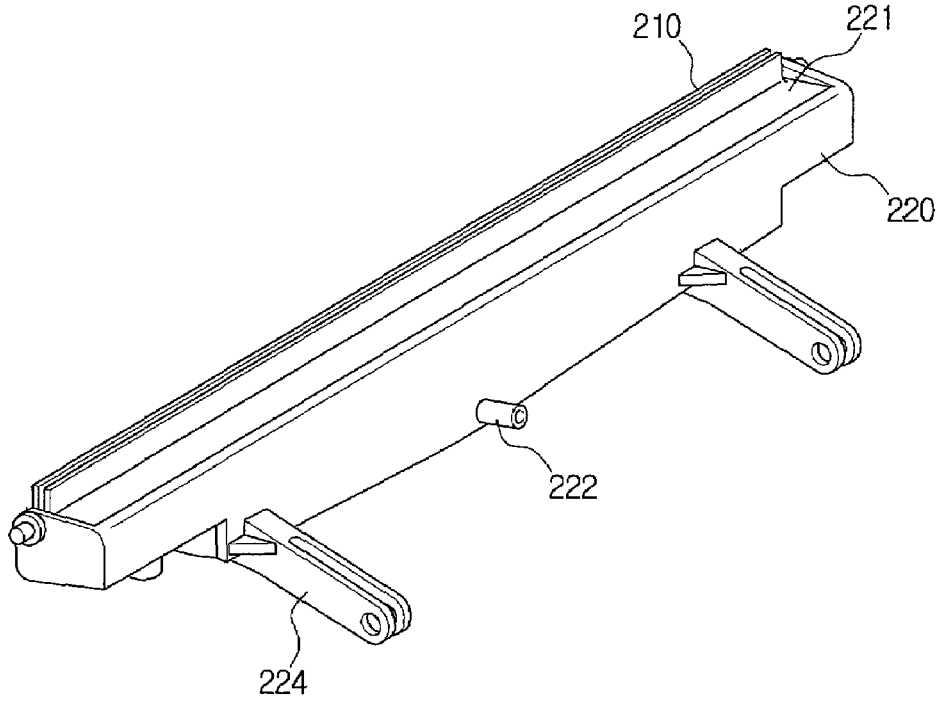
FIG. 5 is a perspective view illustrating a frame illustrated in FIG. 1.

The frame 220 moves back and forth while supporting the blade 210. As illustrated in FIGS. 1 and 5, the frame 220 includes a waste ink container 220*a* having an upper portion which is opened. The waste ink container 220*a* may include an absorbing member 221, such as a sponge. The blade 210 is installed beside the waste ink container 220*a*. As illustrated in FIG. 5, a pair of blades 210 may be installed parallel with each other and at a predetermined distance from each other.

The waste ink container 220*a* contains waste inks spat from the color nozzles 151 through 154 wiped by the blade 210. The waste inks contained in the waste ink container 220*a* may be collected into a predetermined collector through an outlet 222 formed on a lower portion of the frame 220.

The frame 220 is connected to the driver 230 through a pair of connection members 224. Ends of the connection members 224 are pivotably connected to the driver 230. When the driver 230 is driven, the frame 220 moves along a predetermined path so that the blade 210 wipes the nozzle surfaces 150*a* of the plurality of print heads 150.

In other words, as will be described later, when the frame 220 moves toward the plurality of print heads 150 in the direction B, the blade 210 contacts the nozzle surfaces 150*a* so as to wipe the nozzle surfaces 150*a*. Also, the frame 220 moves away from the plurality of print heads 150 and then stands by or returns to an initial position so that the blade 210 is spaced apart from the nozzle surfaces 150*a*.

The driver 230 moves the frame 220, and an example of the driver 230 is illustrated in FIG. 1. In other words, the driver 230 includes a torsion bar 231 to which the connection members 224 of the frame 220 are connected, a platen 232 to which the torsion bar 231 is pivotably connected, and a pivoting lever 233 which pivots the platen 232.

Figure 6A:
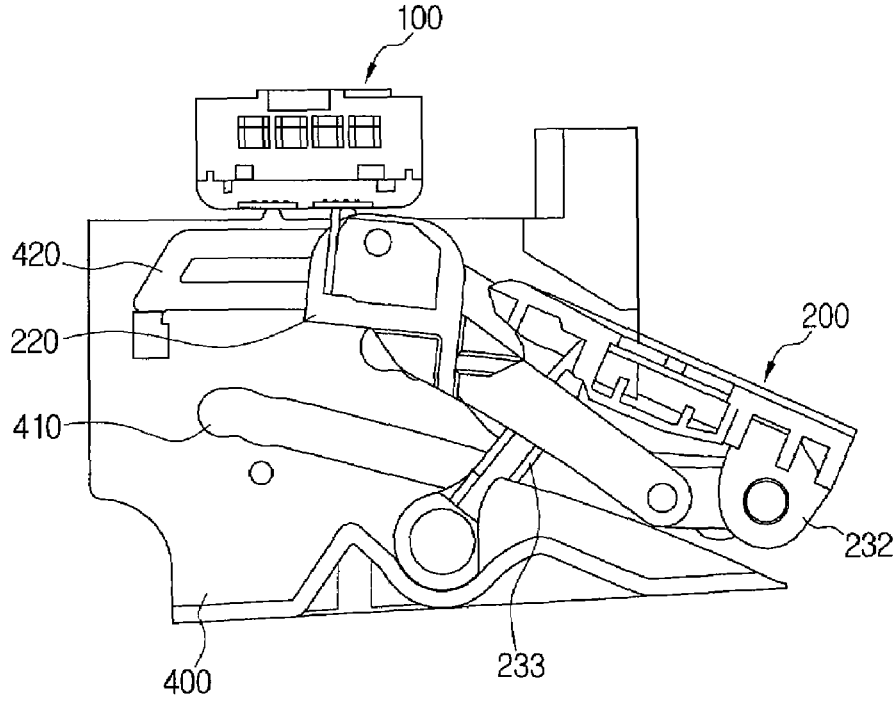
FIGS. 6A through 6C are views illustrating an operation of the frame in a state of the frame illustrated in FIG. 1.
Figure 6B:
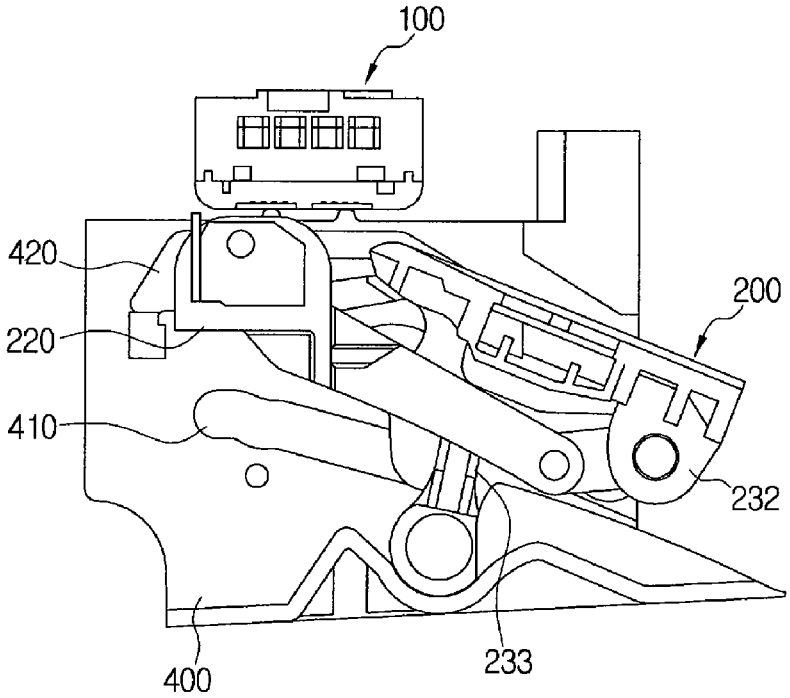

An end of the pivoting lever 233 is pivotably connected to a body 400 of the image forming apparatus and may pivot at a predetermined angle and then return to its initial position by a driving motor (not illustrated). When the driving motor is driven by the controller 300, the pivoting lever 233 of the driver 230 having the above-described structure pivots. Here, as illustrated in FIGS. 6A and 6B, the platen 232 is guided along a cam groove 410 formed in the body 400 to move toward a lower portion of the ink cartridge 100. The frame 220 connected to the connection members 224 is also guided along a cam groove 420 formed in the body 400 to moves toward the lower portion of the ink cartridge 100. These operations allow the blade 210 supported by the frame 220 to wipe the nozzle surfaces 150*a* of the plurality of print heads 150.

Figure 6C:
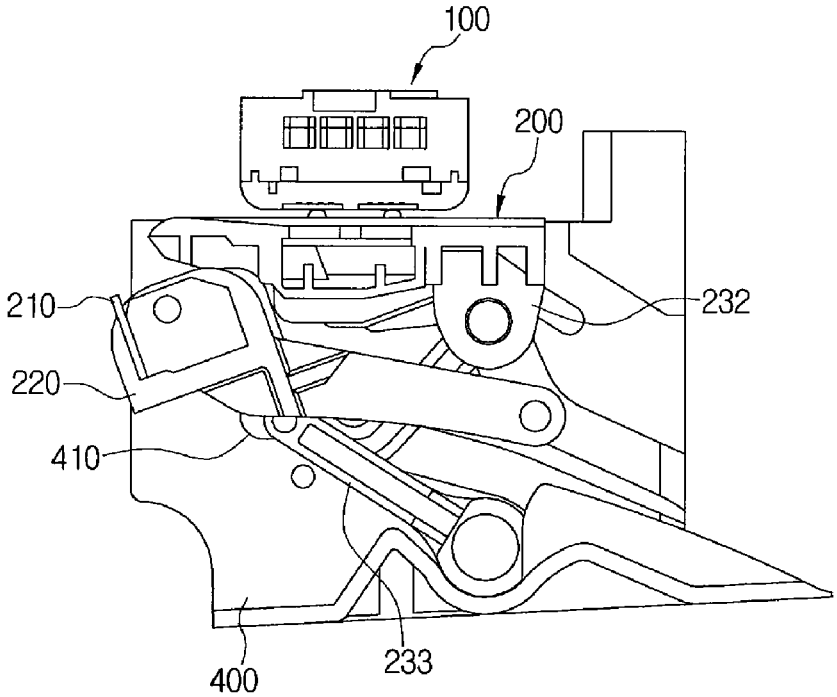

As illustrated in FIG. 6C, the blade 210, which completes wiping, stands by in a position in which the blade 210 is spaced apart from the ink cartridge 100, and the platen 232 is positioned under the ink cartridge 100.

An embodiment of the structure of the driver 230 has been described above, but may be modified into various forms, and is not limited to only the described structure. Thus, its detailed illustration and description will be omitted. In other words, if the driver 230 has a structure to move the frame 220 so that the blade 210 supported by the frame 220 wipes the nozzle surfaces 150*a* of the plurality of print heads 150, the driver 230 must be construed as being realizable to perform the intended operations as described herein. Also, the scope of the present general inventive concept is not limited by the structure of the driver 230.

The controller 300 individually drives the plurality of print heads 150 of the ink cartridge 100 so that the color nozzles 151 through 154 independently spray inks. The controller 300 also drives the driver 230 of the wiping unit 200 to control the wiping operation of the blade 210 performed on the nozzle surfaces 150*a*, i.e., a wiping timing, a wiping speed, etc.

A method of driving the image forming apparatus having the above-described structure according to an embodiment of the present general inventive concept will now be described in detail.

The method may be divided into a wiping operation to wipe the nozzle surfaces 150*a* of the plurality of print heads 150, and a spitting operation to drive the color nozzles 151 through 154 of the plurality of wiped print heads 150 to spray predetermined amounts of inks. To achieve the wiping operation, the driver 230 drives the frame 220 to move the frame 220 so that the blade 210 moves in contact with the nozzle surfaces 150*a* as described with reference to FIGS. 1 and 6A through 6C.

The wiping operation will be described in more detail based on movement states of the frame 220 and the blade 210 with reference to FIGS. 7A and 7B.

Figure 7A:
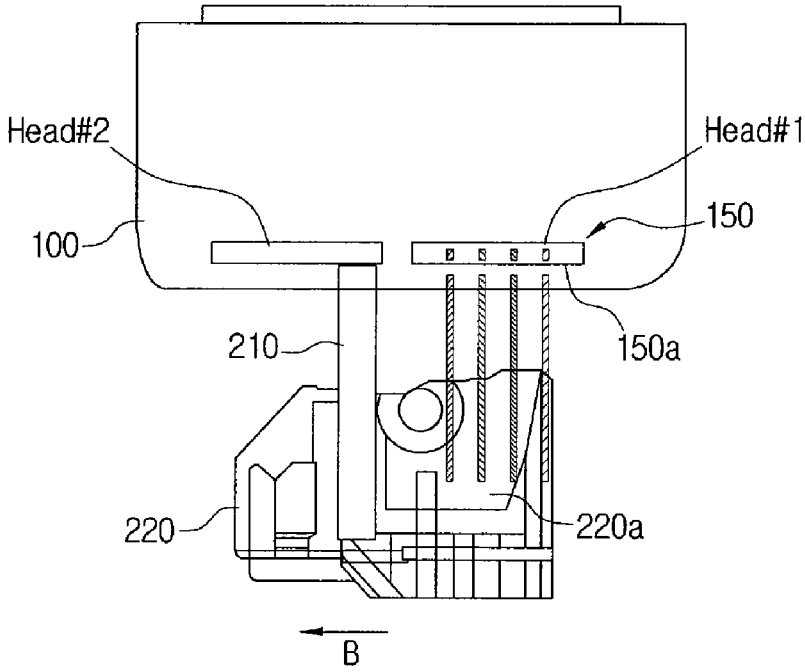
FIGS. 7A and 7B are views illustrating a method of driving an image forming apparatus according to an embodiment of the present general inventive concept.
Figure 7B:
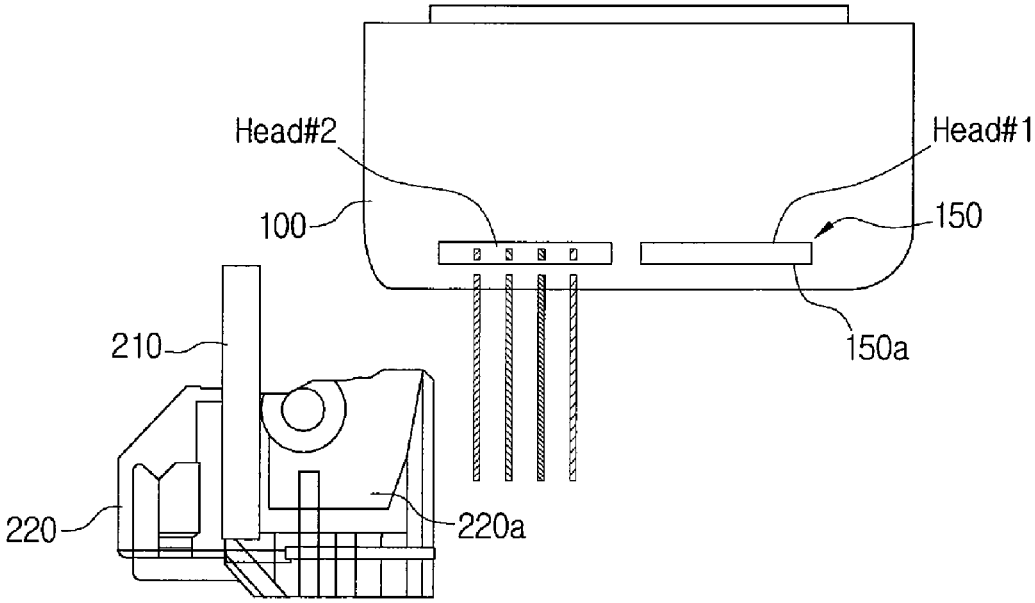

As illustrated in FIG. 7A, the blade 210 moves toward a direction B to first wipe the nozzle surfaces 150*a* of the print heads Head #1 in the first row. Thereafter, the controller 300 drives the print heads Head #1 in the first row so that all of nozzles of the print heads Head #1 in the first row spit a predetermined amount of mixed ink at the same time, so as to perform the spitting operation.

During the wiping operation, the blade 210 pushes an ink of a predetermined color sticking to the nozzle surfaces 150*a*, into nozzles spitting an ink of a different color. The mixture of the inks is wholly spat during the spitting operation and then is contained in the waste ink container 220*a* of the frame 220.

Next, the blade 210 further moves in the direction B to wipe the nozzle surfaces 150*a* of the print heads Head #2 in the second row. Thereafter, the print heads Head #2 in the second row are driven at the same time to perform the spitting operation so that all of nozzles of the print heads Head #2 in the second row spit a mixed ink at the same time.

If print heads Head #1 and Head #2 in the plurality of rows in the arrangement pattern of the plurality of print heads 150 are arranged in a plurality of rows sequentially perform the spitting operation as described above, the time required for performing the wiping and spitting operations may be reduced. In the present general inventive concept, both the time required for performing the wiping and spitting operations and an amount of mixed ink in each nozzle may be reduced as compared to the prior art, in which the plurality of print heads perform a spitting operation at the same time after a plurality of print heads are all wiped. In other words, while the print heads Head #2 in the second row are wiped, the ink pushed into the nozzles of the print heads Head #1 in the first row, which have been wiped, reversely diffuses. Thus, an amount of the mixed ink is increased. As a result, an amount of the mixed ink to be spat is increased. Therefore, in the present general inventive concept, wiped print heads may sequentially perform a spitting operation. Thus, an amount of mixed ink in nozzles can be minimized, and a spat amount of ink can be reduced. As a result, ink can be saved.

Also, if a large amount of ink is spat, a fog generated during a spray of the ink contaminates the surroundings of the image forming apparatus. However, in the present general inventive concept, an amount of ink spat during a spitting operation can be reduced to prevent a fog from being generated.

A method of driving an image forming apparatus according to another embodiment of the present general inventive concept will now be described with reference to FIGS. 8A through 8D. Even in the present embodiment, a spitting operation is performed after a wiping operation is performed. However, the present embodiment is characterized in that the spitting operation alternates with the wiping operation in order of wiping the color nozzles 151 through 154 of the plurality of print heads 150.

Figure 8A:
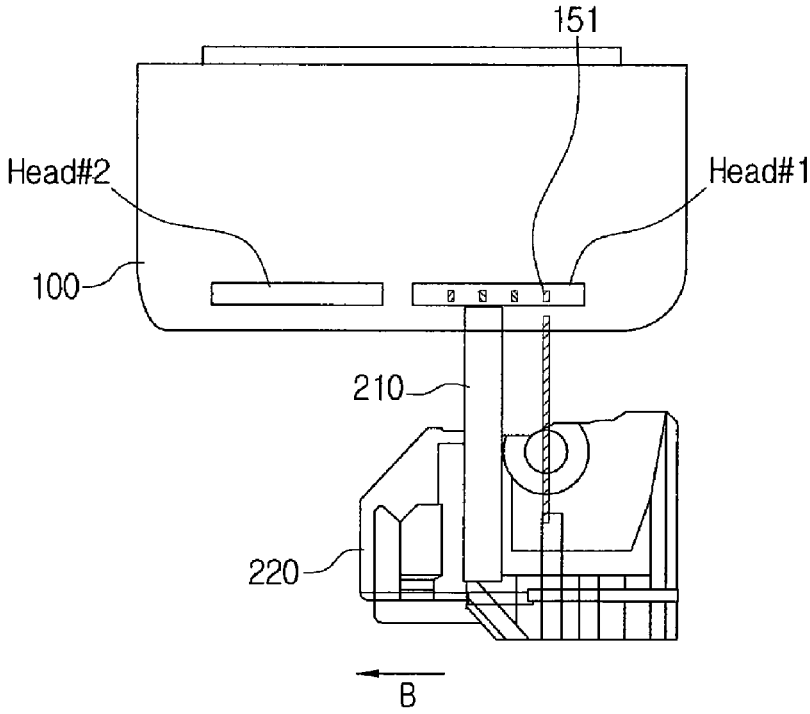
FIGS. 8A through 8D are views illustrating a method of driving an image forming apparatus according to another embodiment of the present general inventive concept.
Figure 8B:
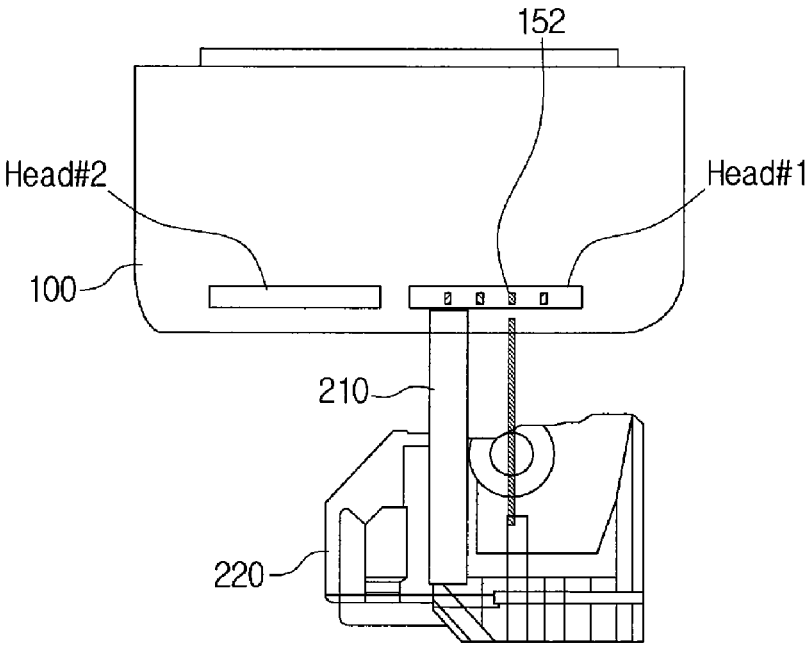
Figure 8C:
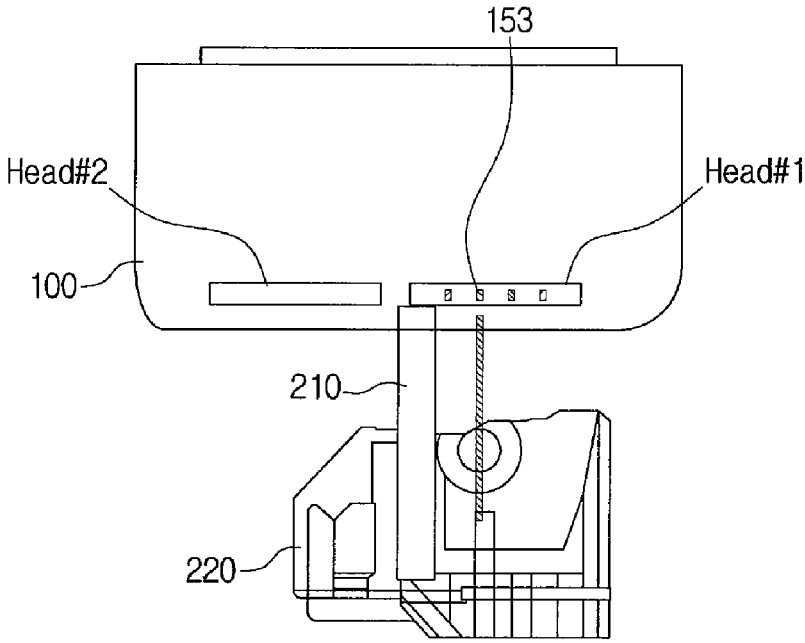
Figure 8D:
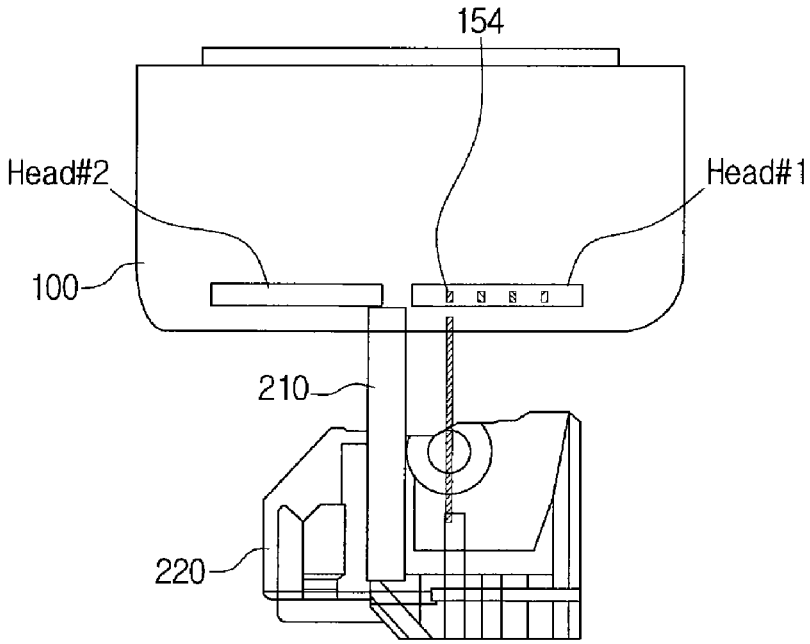

In other words, the blade 210 moves in a direction B to first wipe the nozzle surfaces 150*a* of the print heads Head #1 in the first row. Here, the first nozzles 151 performs the spiting operation immediately after the blade 210 wipes the first color nozzles 151 of the color nozzles 151 through 154 respectively spitting four colors. As illustrated in FIGS. 8B, 8C, and 8D, the nozzles 152, 153, and 154 sequentially perform the spitting operation in the order of wiping the nozzles 152, 153, and 154. Also, the blade 210 wipes the nozzle surfaces 150*a* of the print heads Head #2 in the second row, and then the color nozzles 151 through 154 sequentially perform the spiting operation in the order of wiping the nozzle surfaces 150*a* so that the nozzles 151 through 154 sequentially spit inks.

If the color nozzles 151 through 154 sequentially perform the spitting operation after the nozzle surfaces 150*a* of the plurality of print heads 150 are wiped as described above, the time required for performing the wiping and spitting operations can be reduced. Also, the controller 300 controls the color nozzles 151 through 154 which have been wiped to perform the spitting operation immediately after the wiping operation. Thus, an ink pushed into the color nozzles 151 through 154 during the wiping operation can be further effectively prevented from reversely diffusing into the color nozzles 151 through 154.

Also, the spitting operation can be rapidly performed to reduce an amount of mixed ink due to the reverse diffusion of the ink in the wiped color nozzles 151 through 154. In other words, before an amount of mixed ink is increased due to the reverse diffusion, the mixed ink is rapidly spat. Thus, an amount of mixed ink to be spat during the spitting operation is reduced. As a result, an excess amount of wasted ink can be reduced.

Moreover, the spitting operation may be performed on the plurality of print heads 150 arranged in the direction B or the color nozzles 151 through 154. Furthermore, a speed of the spitting operation may be proportional to a speed of the wiping operation and controlled by the controller 300.

Figure 9:
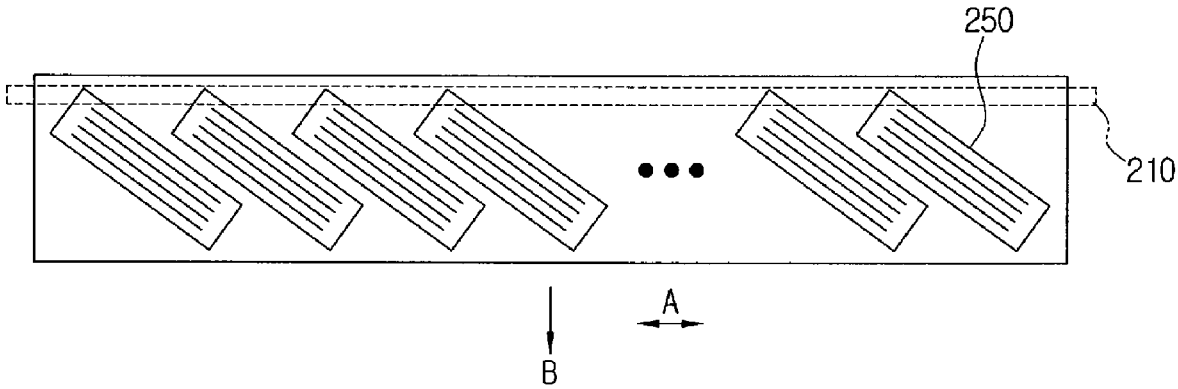
FIG. 9 is a view illustrating an arrangement state of print heads according to another embodiment of the present general inventive concept.

As illustrated in FIG. 9, an ink cartridge including a plurality of print heads 250 arranged at an angle with respect to a direction A or B may be realized. In this case, after the blade 210 moves in the direction B to wipe nozzles, the nozzles may perform a spitting operation at the same time. In other words, color nozzles positioned in a line in the direction A perform the spitting operation to sequentially spit mixed inks at predetermined intervals in the direction B regardless of the arrangement of the color nozzle or the plurality of print heads 250. Even in this case, the above-described effects may be obtained.

As described above, in an image forming apparatus and a method of driving the image forming apparatus according to the present general inventive concept, a blade can move in a direction along which a paper sheet is transferred to simultaneously wipe a plurality of print heads arranged in an array type configuration. Thus, the time required for wiping the plurality of print heads can be reduced.

Also, a spitting operation to spit an ink pushed into and reversely diffused into nozzles by the blade during the wiping can be performed on the plurality of print heads arranged in the direction of the nozzles. Thus, an amount of mixed ink in each of the nozzles can be reduced.

Before a reversely diffused amount of the pushed ink has the opportunity to accumulate, the spitting operation can be rapidly performed. Thus, an amount of mixed ink to be spat can be reduced. As a result, since an amount of an ink spat during the spitting operation is reduced, an excess amount of wasted ink may be reduced.

Moreover, an amount of spat ink can be reduced. Thus, the generation of a fog due to the spitting of the ink can be minimized to minimize a contamination caused by the generation of the fog.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An image forming apparatus comprising:

an ink cartridge comprising a plurality of print heads arranged in a width direction of a printing medium to cross a direction along which the printing medium is transferred;

a wiping unit to move in the transfer direction to wipe nozzle surfaces of the plurality of print heads; and a controller to independently drive the plurality of print heads which have been wiped by the wiping unit, so that color nozzles of the plurality of print heads spray predetermined amounts of inks;

wherein the controller controls the print head nozzles to eject ink in a sequence in which the print heads are wiped by the wiping unit.

2. The image forming apparatus of claim 1, wherein each of the plurality of print heads comprises the color nozzles which are spaced apart from one another in the transfer direction and parallel to the width direction to spray inks of different colors, wherein the color nozzles are independently driven by the controller.

3. The image forming apparatus of claim 1, wherein the controller controls the color nozzles of the plurality of print heads to sequentially spray inks in an order of wiping the color nozzles using the wiping unit.

4. The image forming apparatus of claim 1, wherein;

the plurality of print heads are arranged in first and second rows to be parallel to the width direction and spaced apart from one another in the transfer direction; and the wiping unit wipes the print heads in the first row and then wipes the print heads in the second row.

5. The image forming apparatus of claim 4, wherein the controller controls the printing heads in the first row so that the color nozzles of the print heads in the first row simultaneously spray inks after the print heads in the first row are completely wiped and then the print heads in the second row so that the color nozzles of the print heads in the second row simultaneously spray inks after the print heads in the second row are completely wiped.

6. The image forming apparatus of claim 1, wherein the wiping unit comprises:

a blade parallel to the width direction to wipe the plurality of print heads;

a frame supporting the blade and comprising a container containing inks sprayed from the wiped print heads; and a driver to move the frame back and forth along a predetermined path so that the blade wipes the nozzle surfaces of the print heads.

7. The image forming apparatus of claim 6, wherein a pair of blades are provided parallel to the width direction.

8. A method of driving an image forming apparatus, comprising:

wiping nozzle surfaces of a plurality of print heads arranged in a width direction of a printing medium to cross a direction along which the printing medium is transferred; and spraying inks penetrated into wiped color nozzles to remove the inks;

wherein the inks are sprayed in a sequence in which the print heads are wiped.

9. The method of claim 8, wherein the wiping of the nozzle surfaces of the plurality of print heads arranged in the width direction of the paper sheet crossing the direction along which the printing medium is transferred comprises:

providing a blade parallel to the width direction and having enough length to simultaneously overlap with the plurality of print heads; and moving the blade in the transfer direction so that the blade wipes the nozzle surfaces of the plurality of print heads.

10. The method of claim 9, wherein the color nozzles sequentially spray the inks in an order of wiping the color nozzles using the blade.

11. The method of claim 10, wherein a speed of sequentially spraying the inks from the color nozzles is proportional to a speed of moving the blade.

12. The method of claim 9, wherein:

the plurality of print heads are arranged in first and second rows to be spaced apart from one another toward the transfer direction; and the spraying of the inks penetrating into the wiped color nozzles to remove the inks comprises:

simultaneously driving the print heads in the first row which are completely wiped to spray the inks; and simultaneously driving the print heads in the second row which are completely wiped to spray the inks.

13. The method of claim 8, further comprising collecting the sprayed inks.

14. An image forming apparatus comprising:

a wiping unit to move in a direction parallel to a direction in which a printing medium is transferred to wipe nozzles of print heads arranged in a plurality of rows along the transferring direction; and a controller to drive the wiped print head nozzles to spit a predetermined amount of ink;

wherein the controller controls the print head nozzles to eject ink in a sequence in which the print heads are wiped by the wiping unit.

15. The apparatus of claim 14, wherein the controller controls the print head nozzles to sequentially spit the inks in an order of the wiping of the nozzles.

16. The apparatus of claim 15, wherein a speed of sequentially spitting the inks from the print head nozzles is proportional to a speed of moving the wiping unit.

17. The apparatus of claim 14, further comprising a container to collect the ink spit from the print head nozzles.

18. A method of driving an image forming apparatus, the method comprising:

moving a wiping unit in a direction parallel with a direction in which a printing medium is transferred to wipe nozzles of print heads arranged in a plurality of rows along a transferring direction; and controlling the nozzles to spit a predetermined amount of ink in a sequence corresponding to the sequence in which the nozzles are wiped.

* * * * *